US010012228B2

(12) United States Patent
Esders

(10) Patent No.: US 10,012,228 B2
(45) Date of Patent: Jul. 3, 2018

(54) VARIABLE FLUID FLOW HYDRAULIC PUMP

(71) Applicant: Danfoss Power Solutions GmbH & Co. OHG, Neumunster (DE)

(72) Inventor: Hans Esders, Hildesheim (DE)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 383 days.

(21) Appl. No.: 14/680,462

(22) Filed: Apr. 7, 2015

(65) Prior Publication Data

US 2015/0300349 A1 Oct. 22, 2015

(30) Foreign Application Priority Data

Apr. 17, 2014 (EP) ..... 14165149

(51) Int. Cl.
*F04B 49/22* (2006.01)
*F04B 49/24* (2006.01)
(Continued)

(52) U.S. Cl.
CPC ..... *F04B 49/22* (2013.01); *F04B 1/0452* (2013.01); *F04B 1/0531* (2013.01); *F04B 1/06* (2013.01);
(Continued)

(58) Field of Classification Search
CPC .. F02M 59/025; F02M 59/027; F02M 59/102; F02M 59/36; F02M 59/361;
(Continued)

(56) References Cited

U.S. PATENT DOCUMENTS 2,366,771 A * 1/1945 Da Costa ..... F02M 59/22 417/496
3,727,521 A 4/1973 Reynolds
(Continued)

FOREIGN PATENT DOCUMENTS

CN 1807872 A 7/2006
CN 102124222 A 7/2011
(Continued)

OTHER PUBLICATIONS

Communication pursuant to Article 94(3) EPC for European Patent Application No. EP15163467.2 dated Oct. 12, 2016.

*Primary Examiner* — Peter J Bertheaud
(74) *Attorney, Agent, or Firm* — McCormick, Paulding & Huber LLP

(57) ABSTRACT

A variable fluid flow hydraulic pump including one or more displacement bodies having a fixed volume chamber. Within this fixed volume chamber a piston cycles or reciprocates thus providing for the movement of fluid. Also present is a low pressure valve connecting said displacement chamber with the low pressure side. Additionally, a high pressure valve may be provided on the high pressure side. The low pressure valve is provided with an adjustable element or Fcontrol providing an opening force thereon and further providing a closing force, which periodically increases during the pumping stroke and decreases during the suction stroke of said piston reciprocating within the displacement body and further includes an element to supply fluid from the low pressure side to said fixed volume chamber of the displacement body while the pressure in the displacement chamber is less than that of the low pressure side.

20 Claims, 6 Drawing Sheets

(51) Int. Cl.

| | |
|---|---|
| ***F04B 1/04*** | (2006.01) |
| ***F04B 1/053*** | (2006.01) |
| ***F04B 1/06*** | (2006.01) |
| ***F04B 49/03*** | (2006.01) |
| ***F04B 13/00*** | (2006.01) |
| ***F04B 19/22*** | (2006.01) |
| ***F04B 49/06*** | (2006.01) |
| ***F04B 53/10*** | (2006.01) |
| ***F04B 53/14*** | (2006.01) |
| ***F04B 53/16*** | (2006.01) |

(52) U.S. Cl.
CPC ..... *F04B 13/00* (2013.01); *F04B 19/22* (2013.01); *F04B 49/03* (2013.01); *F04B 49/06* (2013.01); *F04B 49/225* (2013.01); *F04B 49/24* (2013.01); *F04B 49/243* (2013.01); *F04B 53/1085* (2013.01); *F04B 53/14* (2013.01); *F04B 53/16* (2013.01)

(58) Field of Classification Search
CPC ..... F04B 49/22; F04B 49/225; F04B 49/24; F04B 49/243
USPC ..... 417/307, 309, 311, 568
See application file for complete search history.

(56) References Cited

U.S. PATENT DOCUMENTS

| | | | | |
|---|---|---|---|---|
| 5,984,651 | A * | 11/1999 | Beck | B60T 8/4031 137/112 |
| 6,457,957 | B1 * | 10/2002 | Bauer | F04B 1/0408 417/545 |
| 6,558,142 | B2 * | 5/2003 | De Matthaeis | F02M 59/06 123/495 |
| 6,959,694 | B2 * | 11/2005 | Kieferle | F02M 59/464 123/446 |
| 7,198,033 | B2 * | 4/2007 | Inaguma | F02D 41/3845 123/198 D |
| 7,210,463 | B2 * | 5/2007 | Haberer | F02M 55/00 123/495 |
| 2003/0029423 | A1 * | 2/2003 | Boehland | F02M 53/00 123/450 |
| 2003/0110935 | A1 | 6/2003 | Nippert | |
| 2005/0211224 | A1 | 9/2005 | Inaguma et al. | |

FOREIGN PATENT DOCUMENTS

| | | |
|---|---|---|
| EP | 1306553 A2 | 5/2003 |
| GB | 521887 | 6/1940 |

* cited by examiner

VARIABLE FLUID FLOW HYDRAULIC PUMP

CROSS REFERENCE TO RELATED APPLICATIONS

Applicant hereby claims foreign priority benefits under U.S.C. § 119 from European Patent Application No. EP14165149 filed on Apr. 17, 2014, the contents of which are incorporated by reference herein.

TECHNICAL FIELD

Embodiments disclosed herein generally relate to variable flow pump. More specifically, embodiments disclosed herein relate to a variable fluid flow hydraulic pump having a displacement body of a fixed volume chamber.

BACKGROUND

There exist a variety of work machines, for example, hydraulic excavators, wheel loaders, off-highway vehicles, mining machines and other heavy construction vehicles or machines which are used to perform a variety of tasks. In order to achieve this, work machines require a power source, such as, a diesel engine, a gasoline engine, a natural gas engine, a turbine engine or any other type of power source that provides the required power. Such work machines often further include various hydraulically-powered implements or hydraulic drive motors.

Generally, work machines include a pump operatively coupled to the power source for producing a flow of pressurized hydraulic fluid to power implements or drive motors of the machine. In many work machines, the pump is of a variable displacement types. Control systems of these machines adjust the fluid volume displaced by the pump each cycle based on various operating conditions or requirements. For example, the control systems may increase the displacement of the hydraulic pump in response to increased power needs of various work machine implements. Increasing, the displacement of the pump also increases the load the pump places on the power source, which may adversely affect operation of the power source. In some circumstances, if a variable-displacement pump is operated at a relatively high displacement, the power requirements of the pump may exceed the power capacity of the power source.

A variety of rotary pumps with displacement control are known, for example the device as described in U.S. Pat. No. 3,727,521 which discloses an axial piston pump including a rotary cylinder block with reciprocal pistons controlled by an adjustable swash plate for varying displacement as the cylinder block rotates against a valve plate, together with a control port in the valve plate for supplying fluid under pressure to the pumping pistons for controlling the position of the swash plate and therefore the displacement through the medium of the pumping pistons rather than separate control means.

Further prior art such as GB patent 521887 discloses a hydraulic control system having a variable delivery pump which supplies a motor through a throttle valve, means are provided for maintaining the pressure drop across the throttle which means is controlled by the pressure between the pump and the throttle and between the throttle and the motor. A variable delivery pump is used to drive a motor through a system which includes the control valve and a throttle. The pipe lines to and from the throttle are connected to the branches which pass to a control cylinder that is used to vary the delivery of the pump. When the pressure difference across the throttle opening varies from the predetermined one, the result of difference of pressure in the lines causes movement of the controlled piston which regulates the pump until the datum difference is re-established.

Known valve controlled pumps may control the flow of fluid use a check valve rather than a valve plate. However, these devices usually do not seek to provide a variable fluid flow as a mechanism to achieve this is too complex and, so can be unreliable. Digital Displacement Pump® or DDP technology may use computer driven valves rather than a mechanical approach for flow control. However, using this technology in valve controlled pumps requires a large overhead to switch the valves quickly and in the correct synchronicity with the angle of the shaft and actuation of the valves.

SUMMARY

Embodiments of the present invention make use of part of the stroke of a valve controlled pump in order to achieve variable flow and to achieve that using hydraulic-mechanical means.

In one aspect, one or more embodiments of the present invention relate to a variable fluid flow hydraulic pump comprising at least one displacement body having a fixed volume chamber, a piston reciprocating within said displacement body, and further comprising a low pressure valve connecting said displacement chamber with the low pressure side, characterized in that said low pressure valve is provided with adjustable means providing an opening force thereon and further providing a closing force, which periodically increases during the pumping stroke and decreases during the suction stroke of said piston reciprocating within the displacement body and further comprises means to supply fluid from the low pressure side to said fixed volume chamber of the displacement body while the pressure in the displacement chamber is less than that of the low pressure side. Said opening force and said closing force will operate together (typically at least essentially opposing each other), and result in a resulting force that will act on the low-pressure valve, in particular on the closure device of the low-pressure valve. Of course, in reality some additional forces might act on the low-pressure valve as well, for example fluid flow forces during the upward stroke/pumping stroke of the respective piston. The fluid flow forces can (and preferably should) be taken into account, in particular when designing/adjusting the closing movement/timing of the low-pressure valve. By adjusting the adjustable means that are providing said opening force, the position of the piston can be adjusted as a consequence as well, since the position of the piston where the force balancing will occur will vary. This way, the switching position of the inlet valve can be changed; as a consequence, the pumping fraction of the respective pumping cavity can be varied (ratio of the part of the piston's movement, where during the pumping stroke "idle" pumping toward the low-pressure reservoir is performed versus the part of the piston's movement, where an "effective pumping" toward the high-pressure reservoir is performed). Using the presently proposed design, it is possible to achieve a lot or even most of the advantages of synthetically commutated hydraulic pumps/digital displacement Pumps®, as known in the state of the art. However, the overall design is usually much simpler and less costly. In particular, it is no longer necessary to use the very complicated and costly design of the fluid inlet valves, as they are used with present synthetically commutated hydraulic pumps. It should be noted, however, that with the presently proposed design, it is normally not possible to switch between two pumping fractions from one pumping cycle to the other, in particular, if the two pumping fractions are quite different. This has the consequence that a mixing of a plurality of (comparatively) different pumping ratios to come up with a particularly advantageous overall output (particularly advantageous if a larger number of pumping cavities are involved) is usually not possible anymore; instead, usually a series of (essentially) the same pumping ratio will be used with the presently proposed design. Nevertheless, this (slight) disadvantage is usually overcompensated by the much simpler design, at least for a variety of applications. The periodical increases of the closing force during the pumping stroke and decreases during the suction stroke of said piston are preferably done by "mechanical means". This way, usually the energy form does not have to be changed (for example using an electric actuation of the fluid inlet valve). Thus, a simpler design can result. The "mechanical coupling", however, is not performed by a "stiff connection", where a "forced movement" will result. Instead, the coupling is somewhat flexible/elastic, so that only a force is generated (in the present context usually the closing force), so that the resulting movement of the respective device onto which the force acts is not "mandatory", but instead can be "influenced" by some additional means, in particular by an opposing force (opening force) that is exerted by a controlling means or the like. Nevertheless, a connection by "mechanical means" should usually be interpreted in a broad way in the present context. As an example, if two magnets where their identical poles are opposing each other are used for "generating" the closing force, this should usually still be considered as an "elastic mechanical" connection.

Preferably, the opening force that is adjustable by adjustable means and the closing force are opposing each other, will "add up" to result in a working point where the forces are at least essentially balanced and/or where the closure device of said low pressure valve will change its position during a working cycling of the piston. The latter statement is particularly valid for the upward stroke of the piston. As already mentioned above, some "slight deviations" might occur due to fluid flow forces or the like. These "slight deviations" can (and should) be considered during the design of the pump and/or when changing a control force for selecting the working point.

Preferably, said closing force is provided by a biasing means, where the biasing means is designed in a way to relay a force that is dependent of the position of the piston to the respective closure device of the low pressure valve, in particular to elastically couple a device that is dependent on the position of the piston, preferably of the piston, to the closure device of the low-pressure valve. The suggested relay of a force is preferably effectuated by elastic and/or mechanical means (where the meaning of "mechanical" is usually to be interpreted in a broad way). While a "direct elastic coupling"/mechanical coupling between the piston in the closing member is preferred (in particular due to the comparatively simple design), it is also possible to use a crankshaft or an eccentric (or some other device) as an "input device" for driving the biasing means. Nevertheless, using an appropriate design, it is usually still not necessary to change the energy form to electricity or the like. Instead, the connection can be made by "purely mechanical means". The closure device can be a valve poppet, a ball of a ball valve, a needle of a needle valve or the like.

Preferably, said biasing means comprises a device taken from the group comprising a spring, a helical spring, magnets with opposing identical poles, and permanent magnets with opposing identical poles. Even a combination of two or more of such devices is possible. Such devices proved to be very effective in first experimental designs of the variable fluid flow hydraulic pump.

Preferably, said means to supply fluid from the low pressure side to said fixed volume chamber is a check valve mounted in parallel to the low pressure valve. This way, a fluid supply from the low-pressure fluid reservoir can be "guaranteed", even in very "disadvantageous" positions/settings of the controlling unit. In such cases it is possible that the actuated/influenced fluid inlet valve does not change its position during the suction stroke at all, or somewhat late during the downward movement/suction stroke of the piston.

Preferably, said means to supply fluid from the low pressure side to said chamber is a slot in the driving means of the displacement body, which is connecting the displacement chamber to the low pressure side mainly during the suction stroke Preferably, said means to supply fluid from the low pressure side to said chamber is a combination of a check valve and a channel in the driving means of the piston, which is connecting the (fixed volume) displacement chamber to the low pressure side during the suction stroke.

Preferably, said adjustable means for adjusting said opening force is taken from the group comprising a pressure exerting device, a pressure chamber, an adjustable magnet, an electric coil, a motor, an electric motor, and a stepper motor. Even a combination of two or more of such devices is possible. Such devices proved to be simple and effective in first experimental designs of a hydraulic pump.

Preferably, a dampening device for dampening a controlling force creating (influencing) means can be used (in particular for a force creating means, creating an opening force). This way, "residual ripples" of the controlling force can be avoided. Thus it is possible to avoid unwanted pressure spikes of the hydraulic pump (or the like). Such a design is particularly effective, if a fluid is used for generating the control force. This is due to the fact that the fluid for controlling the control force is usually taken from the fluid circuitry that is supplied by the pump itself. Therefore, some unwanted feedback effects can easily occur. A dampening device can be designed as some kind of a "venting device" in the case of a "control by fluid". Then, it is possible to change the "venting rate" (fluid throughput rate/size of an orifice and so on) by magnetic means (for example by an electric coil, where the magnetic field that is generated by the electric coil acts on a metallic ball that is placed at a certain distance of a valve seat (orifice) that forms the "venting hole"). Since usually only small movements/adjustments are sufficient for the damping device, the resulting device can be comparatively simple, cost-effective and easy to manufacture.

In another aspect, one or more embodiments of the present invention relate to method of varying the flow of a hydraulic pump by means of, providing at least one displacement body of a fixed volume chamber, a piston reciprocating within said displacement body, and further providing a low pressure valve connecting said displacement chamber with the low pressure side characterized in that said low pressure valve is provided with an opening force thereon and is further provided with a closing force, which periodically increases during the pumping stroke and decreases during the suction stroke of said piston reciprocating within the displacement body and further comprises means to supply fluid from the low pressure side to said fixed volume chamber of the displacement body while the pressure in the displacement chamber does not exceed that of the low pressure side.

In particular, the method can be modified in the sense of the previously suggested device, at least in analogy. Likewise, the already mentioned effects and advantages will result when applying the method, at least in analogy.

These and other advantages of the present invention will become apparent upon reading the following description in view of the drawing attached hereto representing, as a non-limiting example, an variable fluid flow hydraulic pump comprising at least one displacement body of a fixed volume chamber.

DETAILED DESCRIPTION

Figure 1:
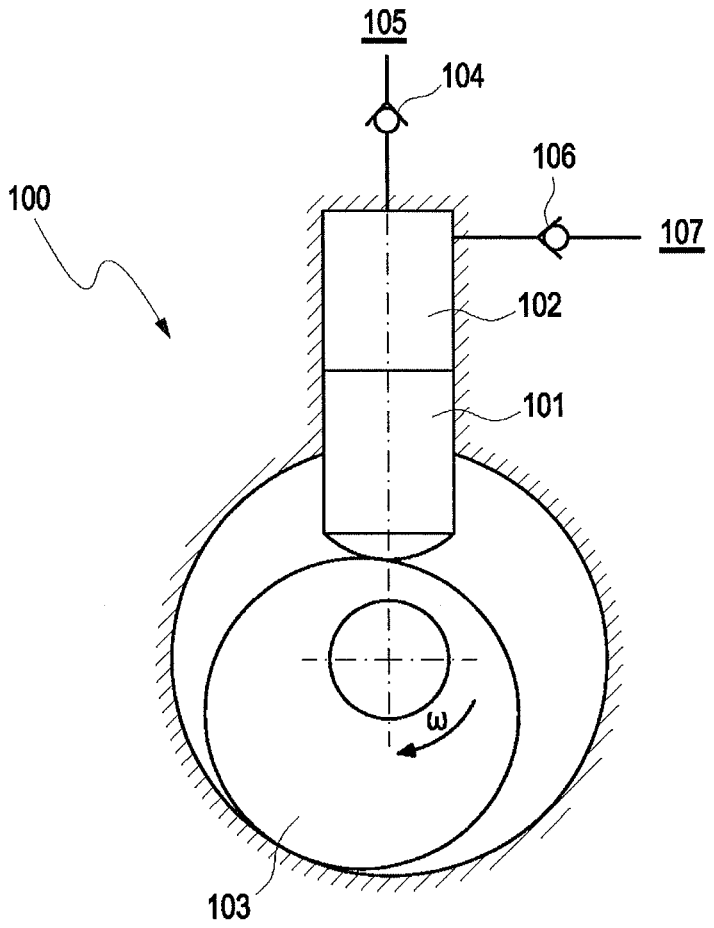
Fig. 1 ( Prior Art )
FIG. 1 is a view of a prior art valve controlled pump according to a form of prior art.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description. In particular these figures illustrate a configuration showing a single displacement body of fixed volume. However, it will be appreciated that in many configurations more than one displacement body 2 will be provided, these bodies will usually be spaced evenly around the rotating eccentric body 11; this arrangement will provide a smoother flow. The spaced bodies 2 will have pistons 4 at varying positions within the chamber 3. In the figures the direction of rotation of the rotating eccentric body 11 is shown as clockwise; of course this direction of rotation is not essential to the invention. In some of the figures components, such as, valves are indicated using symbols, those skilled in the art to which the inventions relates will realize that there are a variety of suitable valves that may achieve the required function. In general check valves are two-port valves, meaning they have two openings in the body, one for fluid to enter and the other for fluid to leave, such valves should be selected to be suitable for the operating fluid and to have a suitable cracking pressure which is the minimum upstream pressure at which the valve will operate.

FIG. 1 shows known art in which a valve controlled pump 100 which has a displacement body 101 having a fixed volume chamber 102. It can be seen that rotation of the rotating eccentric body 103 provides for the cycling of the displacement body 101 by means of bearing on the lower surface thereof and thus provides for the pumping of fluid within the fixed volume chamber 102. Further it can be seen that the provision of a low pressure check valve 104 on the low pressure side 105 of the pump 100 and a high pressure check valve 106 on the high pressure 107 of the pump 100 regulate the flow of fluid. However, it can be seen that such a device does not provide for the varying of displacement of the pump 100 since the displacement control mechanism is difficult to realize and therefore the uses of this devices are somewhat limited.

Figure 2:
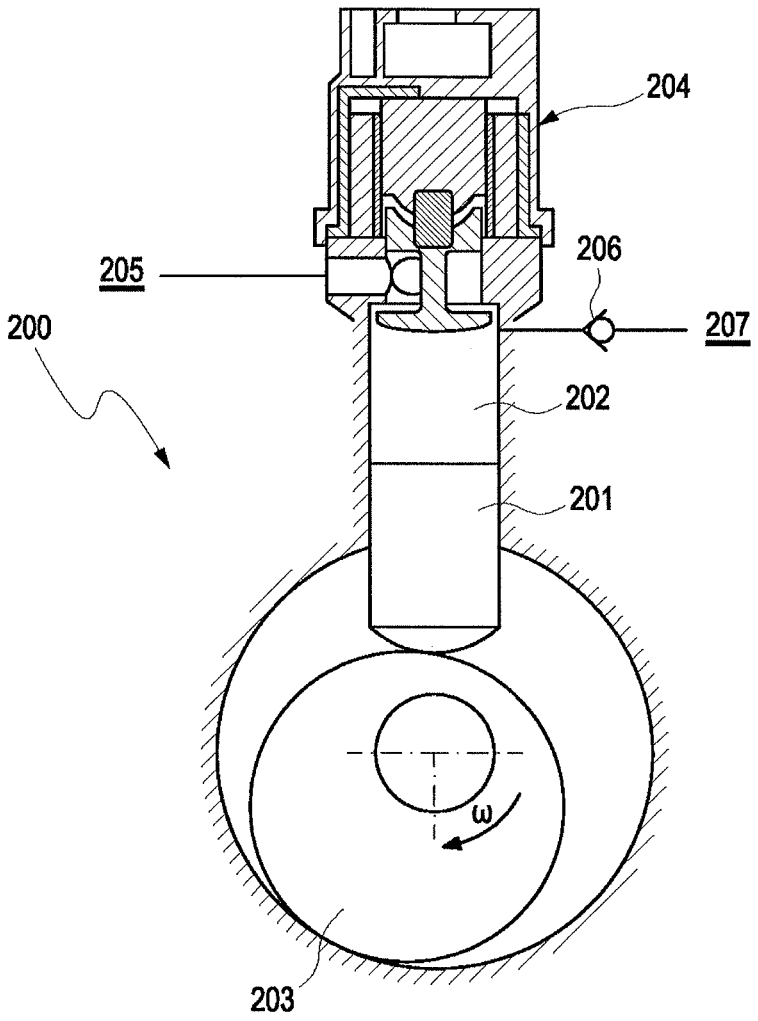
Fig. 2 ( Prior Art )
FIG. 2 is a view of digital displacement Pump® providing a variable displacement pump according to prior art.

FIG. 2 shows another form of known art which is commonly referred to as a Digital Displacement Pump® or DDP. Similar to the device shown in FIG. 1 this is a valve controlled pump 200 which has a displacement body 201 having a fixed volume chamber 202. It can be seen that rotation of the rotating body 203 provides for the cycling of the displacement body 201 by means of bearing on the lower surface thereof and thus provides for the pumping of fluid within the fixed volume chamber 202. Again it can be seen that the provision of a low pressure check valve 204 on the low pressure side 205 of the pump 200 and a high pressure check valve 206 on the high pressure 207 of the pump 200 regulate the flow of fluid. However, in this case the low pressure valve 204 is computer or digitally controlled. The computer controlled valve 204 adds additional cost and complexity to the pump 200 and may reduce reliability and there is significant amount of effort for extremely fast switching valves and perfect synchronization of shaft angle with valve actuation.

Embodiments of the present invention provide for the variation of the fluid flow of a hydraulic pump having a displacement body which itself is not capable of being varied in volume. This is achieved by realizing the part stroke mode of a valve controlled check valve pump with constant displacement by hydraulic-mechanical means and this should provide a lower cost more reliable device than a DDP. The use of a part stroke is the only way to achieve variability, there is not any kind of flow-algorithm or use of an intelligent combination of full strokes and part strokes. In embodiments of the present invention this is achieved by means of changing the state of a low pressure valve in accordance with adjustable means that varies in proportion to the position of said piston within the displacement body and further comprises means to supply fluid from the low pressure side to said chamber of the displacement body.

Figure 3:
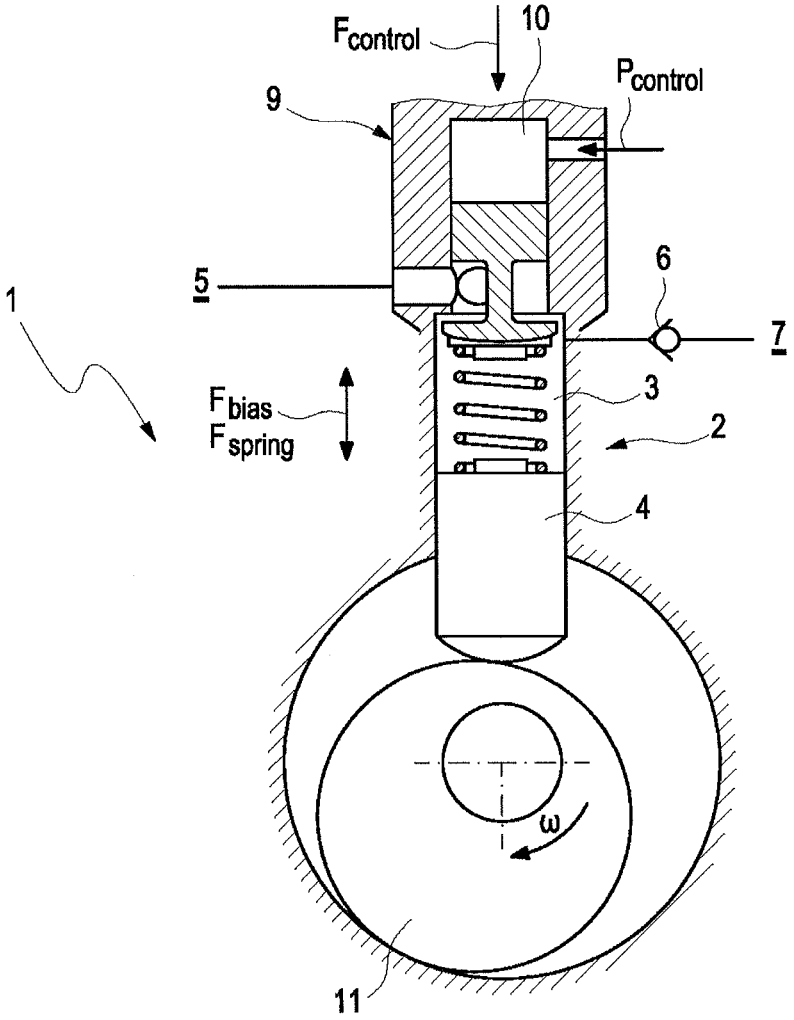
FIG. 3 is s a sectional view according to an embodiment of the present invention.

FIG. 3 shows an embodiment of the present invention which provides a variable fluid flow hydraulic pump 1. Again, it can be seen that rotation of the rotating eccentric body 11 provides for the cycling of the displacement body 4 by means of bearing on the lower surface thereof and thus provides for the pumping of fluid within the fixed volume chamber 3. This pump 1 includes one or more displacement bodies 2 having a fixed volume chamber 3. Within this fixed volume chamber 3 a piston 4 cycles or reciprocates thus providing for the movement of fluid. Also present is a low pressure valve 9 connecting said displacement chamber with the low pressure side 5. Also present in embodiments of the present invention on the high pressure side 7 is a high pressure valve 6.

Figure 4:
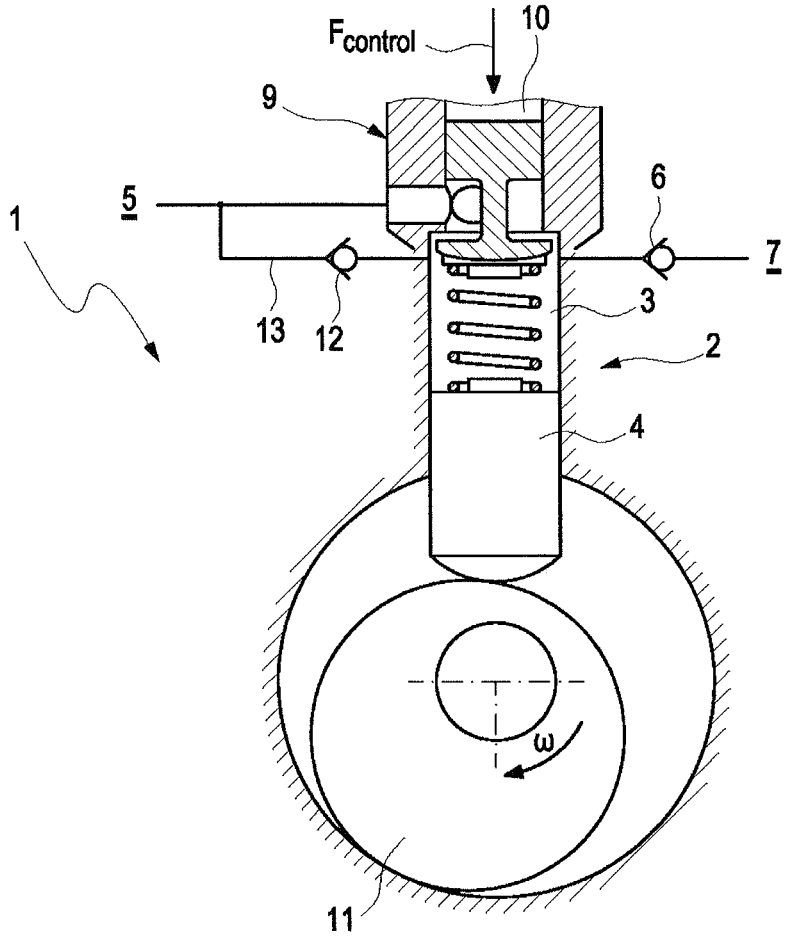
FIG. 4 is s a sectional view according to an embodiment of the present invention.

The low pressure valve 9 is provided with adjustable means 10 shown in FIG. 3 the general direction of which is indicated in FIG. 4, providing an opening force thereon (usually referred to as Fcontrol or control force in the following). This adjustable means 10 may be designed in a variety of ways, for example as a simple coil spring, where a preloading of the coil is adjusted by a stepper motor; as two permanent magnets that are arranged so that their identical poles or facing each other and where the position of one of the permanent magnets can be changed; as a permanent magnet in combination with an electromagnetic coil; as a pressure chamber, so that a pressure will be exerted onto the valve poppet 41 (by liquid, fluid or gas pressure) or even a combination thereof.

This control force Fcontrol is opposed by an opposing force (a biasing force; usually Fbiasing or Fspring in the following) that is generated by a coupling spring 40 in the presently shown embodiment. The coupling spring 40 rests with its one side on the displacement body 4 and with its other side on the movable valve poppet 41 (where the valve poppet 41 is also influenced by force Fcontrol that is generated by controlling means 10). However, it is to be understood that any kind of "force relaying coupling" or "elastic coupling", in particular of a "elastic mechanical coupling" (wherein the "mechanical" can be interpreted in a broad sense; for example, hydraulic means, two permanent magnets that are arranged so that their identical poles are facing or the like could be used as well) could be used for creating the biasing force. In particular an "elastic coupling" between a displacement body 4 and its corresponding valve poppet 41 can be envisaged (although an "elastic coupling between" an eccentric body 11 or another device and the valve poppet 41 could be used as well). By this "elastic coupling" (presently the coupling spring 40), a cyclically changing opposing biasing force Fspring that acts on the valve poppet 41 is created. The strength of the opposing force Fspring is dependent on the position of the displacement body 4 in the volume chamber 3, where typically an essentially linear dependency exists (at least in case a spring 40 is used).

Both forces in combination, i.e. control force Fcontrol and biasing force Fspring will result in a balancing of both forces at a certain position of the displacement body 4. In (or near) this position, the valve poppet 41 will change from its open state to its closed state (during the upward stroke of the displacement body 4; the fluid pumping stroke) or from its closed state to its open state (during the downward stroke of the displacement body 4; the fluid input stroke or suction stroke). It is to be understood that during the upward stroke, no "effective pumping" to the high pressure side 7 is performed, as long as the valve poppet 41 is still open. Only after the valve poppet 41 has closed, such an "effective pumping" to the high-pressure side 7 is performed.

Since, as previously mentioned, the control force Fcontrol is adjustable, the position (i.e. the "timing"), where the valve poppet 41 will change its position can be changed correspondingly. This way, the "effective pumping ratio" (i.e. the percentage of the overall volume of chamber 3 that is "effectively" pumped to the high-pressure side 7) can be changed in a simple way, using simple means (in particular the very expensive and elaborate switchable input valves that are used in synthetically commutated hydraulic pumps/digital displacement Pumps® according to the state of the art can be essentially dispensed with). In other words: by setting a certain "working point", the pumping performance of the pump 1 can be changed from 0 to 100% very quickly and very easily (including a comparatively simple design of the pump 1).

Further a check valve 12 shown in other figures further comprises means to supply fluid from the low pressure side 5 to said fixed volume chamber 3 of the displacement body 4 while the pressure in the displacement chamber 3 is less than that of the low pressure side 5. This way, the filling of the fixed volume chamber 3 can be guaranteed at every phase of the downward stroke, even at very "disadvantageous" settings of the "working point" (where the opening of the valve poppet 41 might be delayed or even hindered).

Figure 5:
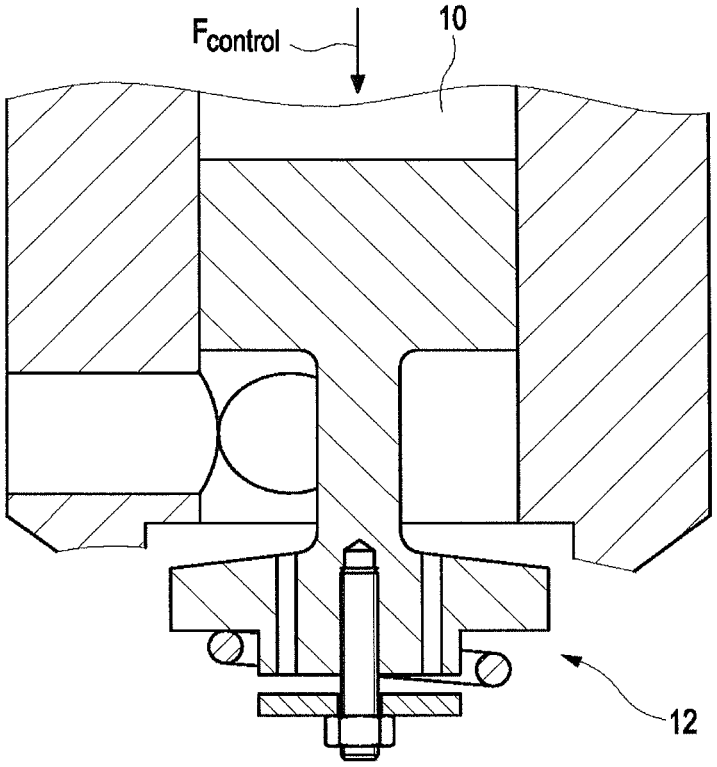
FIG. 5 is s a partial sectional view according to an embodiment of the present invention.

FIG. 4 shows another embodiment of the present invention in which suction check valve 12 is mounted in a parallel arrangement to the low pressure valve 9. This valve 12 must be capable of handling the whole theoretical flow at low pressure drop. In embodiments of the invention it is possible to integrate this additional check valve 12 in the low pressure valve spool and this is shown in the FIG. 5 partial diagram this embodiment of the invention also creates an additional opening force during the suction stroke of the variable fluid flow hydraulic pump 1.

As shown in other figures once the low pressure valve 9 is in this closed state a partial stroke of the piston occurs thus providing the desired partial or variable displacement, that less than the entire volume of the fixed volume of the displacement volume is used to pump fluid. In this way the volume of fluid pumped can be varied to meet the requirements of the machines operating environment. In embodiments of the present invention acting as pumps the displacement or amount of fluid pumped per revolution of input shaft of the pump can be varied while the pump is running. In some cases, these requirements may be the load that the machine is operating under. In other cases the machine may be operating under little or no load in an idling state and thus be ready to operate without delay once it is required to. In this state, it is possible to apply a high force Fcontrol or adjustable means 10, so that the low pressure valve stays open permanently and the pumping piston remains idling, which means it is sucking fluid from the low pressure side and it is pumping it back to the same location.

The magnitude of control force or Fcontrol may be varied and if it exceeds any possible biasing force of Fbias the low pressure valve will remain open thus putting the pump into an idling mode. Fbias may be provided by any suitable biasing means such as a spring providing a force Fspring.

In embodiments of the invention it is desirable to prevent the low pressure valve from opening too late to allow the chamber to fill. For example, as shown in FIG. 4 an additional flow path is provided. Those skilled in the art to which the invention relates will readily appreciate that this can be achieved in a number of ways using conduits to allow for the chamber 3 to fill.

In other embodiments of the invention the check valve control is combined with a valve plate control.

In other embodiments of the present invention a suction check valve 12 may be provided in parallel with the low pressure valve and this check valve 12 must be capable of providing the entire flow at the low pressure drop this is illustrated in FIG. 4.

In yet other embodiments of the present invention there may be provided an additional complex control spool.

Figure 6:
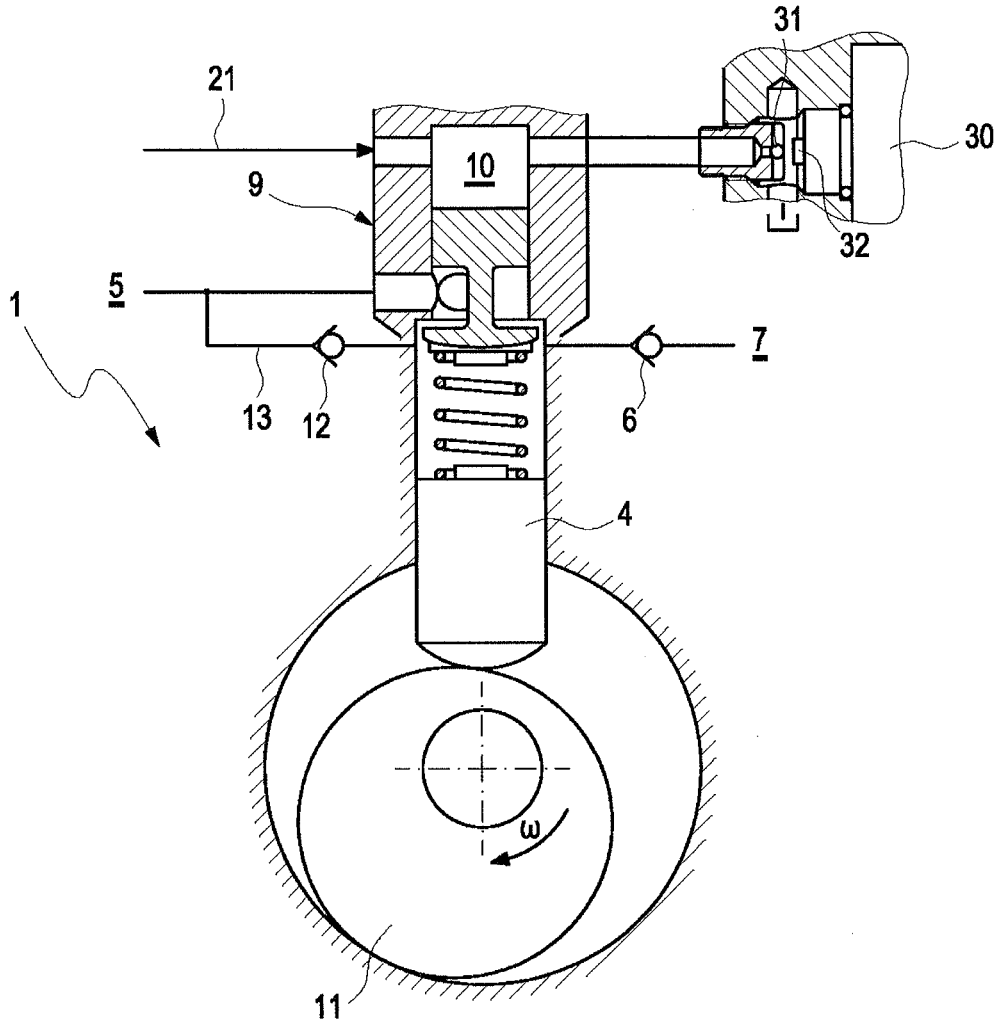
FIG. 6 is s a sectional and system view according to an embodiment of the present invention.

FIG. 6 shows means to minimize the oscillation of control pressure in embodiments of the present invention in order to make sure that the closing of the low pressure valve is not varied beyond desired limits. In these embodiments of the present invention a permanent flow is forced into the control pressure line through a seat valve such as proportional magnet 32 acting on a ball 31. The permanent fluid flow can be either created "on purpose", or the permanent flow can come from a hydraulic consumer that is "present anyhow" (for example the return fluid flow from a power steering in a vehicle). A permanent fluid flow can easily be created "on purpose" by tapping the high-pressure side 7 of the hydraulic pump 1. Using this idea, a fluid flow connection between the high pressure fluid port 7 and the oil inlet connection 21 (see FIG. 6) can be established, preferably by some fluid flow reducing means, for example by using an orifice.

In case of embodiments of the present invention in which the control force being applied using pressure, the oscillation of that control pressure needs to be minimized. Otherwise the closing of the low pressure valve from one cycle to another would vary too much (by "pressure ripples" in the fluid that is creating the control force Fcontrol, which will result in a "shivering" work point), and in the worst case may not close at all. With a normal pilot pressure control valve this might be difficult: the low pressure valves may add or remove quite a bit of flow and therefore pressure peaks to the control pressure line when they open or close. The embodiment of the present invention as shown in FIG. 6 shows means for reducing such problems, in this embodiment a permanent flow, that is, back flow from the charge pressure relief valve or from the steering unit is forced into the control pressure line. The flow goes out of the line through a seat valve. The force of the armature 30 of a proportional magnet 32 is acting upon the ball 31; in other embodiments of the present invention this may comprise a poppet of the seat valve in closing direction. The opening force comes from the pressure in the control pressure line. Due to the permanent flow, the valve is permanently open. If the control pressure changes, only minimal movements of the closing element are sufficient for reestablishing the force equilibrium, which re-adjusts the control pressure to the set point value. Of course, additionally or alternatively different means that provide a certain "smoothing" of the fluid pressure in the control chamber 10 can be used as well. As an example, a simple orifice might already be sufficient (or might be used in addition for providing some "basic smoothing" that will be supplemented by additional means).

Those skilled in the art to which this invention relates will readily appreciate that the internal lubrication of the various surfaces of the machine may be achieve by means of utilizing the operating fluid that is the hydraulic fluid. In such cases the maximum operating temperature of the machine and fluid will therefore need to be accounted for and the fluid may require cooling and filtration at an appropriate stage.

This disclosure in the main refers to embodiments of variable displacement hydraulic machine or pump 1 having displacement bodies 2 of a fixed volume chamber 3. The embodiments herein are described as having, at least one displacement bodies of a fixed volume chamber 3 but figures may, for clarity show only one such chamber, those skilled in the art to which the invention relates will readily realize that various numbers of chambers may be supplied and that these may be arranged in various configurations, in some embodiments a symmetrical arrangement of an even number of such chambers may be preferred, such as four or six but other such arrangements and configurations are possible.

Further, although for the purposes of illustration the description and illustration of embodiments of the present invention have concentrated on the use of an eccentric roller or rotating eccentric body 11 to provide for the cycling of the pistons those skilled in the art to which the invention relates will realize that other means may be used. As an example the use of a wobble plate may provide a similar function.

Those skilled in the art to which this invention relates will appreciate that various modifications and variations can readily be implemented without departing from the scope of this disclosure. There will be other embodiments that are apparent to those skilled in the art to which this invention relates after consideration of the specification and practice of the valve controlled variable pumps disclosed herein. It is therefore intended that the disclosure of these embodiments be considered as exemplary only, with a true scope of the disclosed embodiments being indicated by the following claims and their equivalents.

While the present invention has been illustrated and described with respect to a particular embodiment thereof, it should be appreciated by those of ordinary skill in the art that various modifications to this invention may be made without departing from the spirit and scope of the present.

What is claimed is:

1. A variable fluid flow hydraulic pump comprising at least one displacement body having a fixed volume displacement chamber, a piston reciprocating within said displacement body, further comprising a low pressure valve connecting said fixed volume displacement chamber with a low pressure side, and a check valve arranged in the low pressure valve for connecting said fixed volume displacement chamber with the low pressure side, said check valve being configured to supply fluid from the low pressure side to said fixed volume displacement chamber of the displacement body while the pressure in the displacement chamber is less than that of the low pressure side, wherein said low pressure valve is provided with adjustable means providing an opening force thereon and further providing a closing force, which periodically increases during a pumping stroke and decreases during a suction stroke of said piston reciprocating within the displacement body.

2. The variable fluid flow hydraulic pump as claimed in claim 1, wherein the opening force that is adjustable by adjustable means and the closing force are at least essentially opposing each other, resulting in a working point where the forces are balanced and/or where a closure device of said low pressure valve will change its position during a working cycle of the piston.

3. The variable fluid flow hydraulic pump as claimed in claim 1, wherein said closing force is provided by a biasing means, where the biasing means is designed in a way to relay a force that is dependent on the position of the piston relative to a closure device of the low pressure valve.

4. The variable fluid flow hydraulic pump as claimed in claim 1, wherein said closing force is provided by a biasing means, said biasing means comprises a device taken from the group, comprising a spring, a helical spring, magnets with opposing identical poles, and permanent magnets with opposing identical poles.

5. The variable fluid flow hydraulic pump as claimed in claim 1, further comprising a second check valve, the second check valve being mounted in parallel to the low pressure valve.

6. The variable fluid flow hydraulic pump as claimed in claim 5, further comprising a slot in a driving means of the displacement body, which connects the fixed volume displacement chamber to the low pressure side mainly during the suction stroke of the variable fluid flow hydraulic pump.

7. The variable fluid flow hydraulic pump as claimed in claim 1, wherein the reciprocating of said piston is by means of a rotating eccentric body or by means of a wobble plate.

8. The variable fluid flow hydraulic pump as claimed in claim 1, wherein said adjustable means for adjusting said opening force is taken from the group comprising a pressure exerting device, a pressure chamber, an adjustable magnet, an electric coil, a motor, an electric motor, and a stepper motor.

9. The variable fluid flow hydraulic pump as claimed in claim 8, comprising a dampening device for dampening a control force creating means.

10. The variable fluid flow hydraulic pump as claimed in claim 2, wherein said closing force is provided by a biasing means, where the biasing means is designed in a way to relay a force that is dependent on the position of the piston relative to the closure device of the low pressure valve.

11. The variable fluid flow hydraulic pump as claimed in claim 2, wherein said closing force is provided by a biasing means, said biasing means comprises a device taken from the group, comprising a spring, a helical spring, magnets with opposing identical poles, and permanent magnets with opposing identical poles.

12. The variable fluid flow hydraulic pump as claimed in claim 3, wherein said biasing means comprises a device taken from the group, comprising a spring, a helical spring, magnets with opposing identical poles, and permanent magnets with opposing identical poles.

13. The variable fluid flow hydraulic pump as claimed in claim 2, further comprising a second check valve, the second check valve being mounted in parallel to the low pressure valve.

14. The variable fluid flow hydraulic pump as claimed in claim 3, further comprising a second check valve, the second check valve being mounted in parallel to the low pressure valve.

15. The variable fluid flow hydraulic pump as claimed in claim 4, further comprising a second check valve, the second check valve being mounted in parallel to the low pressure valve.

16. A method of varying the flow of a hydraulic pump by means of, providing at least one displacement body of a fixed volume displacement chamber, a piston reciprocating within said displacement body, and further providing a low pressure valve connecting said fixed volume displacement chamber with a low pressure side, and a check valve arranged in the low pressure valve for connecting said fixed volume displacement chamber with the low pressure side, wherein the method of varying the flow comprises the steps of adjusting said low pressure valve by providing an opening force thereon and providing said low pressure valve with a closing force, said closing force periodically increasing during a pumping stroke and decreasing during a suction stroke of said piston reciprocating within the displacement body, and wherein the method further comprises the step of supplying fluid from the low pressure side to said fixed volume displacement chamber of the displacement body while the pressure in the fixed volume displacement chamber does not exceed that of the low pressure side.

17. The method of varying the flow of a hydraulic pump as claimed in claim 16 wherein the adjustable opening force and the closing force are at least essentially opposing each other, thereby providing an adjustable working point where the forces are balanced and/or where a closure device of said low pressure valve will change its position during a working cycling of the piston.

18. The method of varying the flow of a hydraulic pump as claimed in claim 16, wherein said closing force is provided by a biasing means, where the biasing means is designed in a way to relay a force that is dependent on the position of the piston relative to a closure device of the low pressure valve.

19. The method of varying the flow of a hydraulic pump as claimed in claim 16, further comprising a second check valve, the second check valve being mounted in parallel to the low pressure valve.

20. The method of varying the flow of a hydraulic pump as claimed in claim 16, wherein said supplying of fluid from the low pressure side to said fixed volume displacement chamber is via comprises a slot in a driving means of the displacement body connecting the fixed volume displacement chamber to the low pressure side mainly during the suction stroke.

* * * * *